United States Patent [19]

Qualeatti

[11] Patent Number: 4,547,319

[45] Date of Patent: Oct. 15, 1985

[54] SELECTIVE REDUCTION OF EDIBLE FATS AND OILS USING PHOSPHORUS-MODIFIED NICKEL CATALYSTS

[75] Inventor: Gail M. Qualeatti, Palatine, Ill.

[73] Assignee: UOP Inc., Des Plaines, Ill.

[21] Appl. No.: 541,644

[22] Filed: Oct. 13, 1983

[51] Int. Cl.[4] ..... C11C 3/12

[52] U.S. Cl. ..... 260/409

[58] Field of Search ..... 260/409

[56] References Cited

U.S. PATENT DOCUMENTS

| | | | |
|---|---|---|---|
| 2,656,371 | 10/1953 | Baldwin et al. | 260/409 |
| 2,671,097 | 3/1954 | Royce et al. | 260/409 |
| 3,139,408 | 6/1964 | Tumer et al. | 260/409 |
| 4,118,342 | 10/1978 | Debus et al. | 260/409 X |
| 4,201,718 | 5/1980 | Marsch | 260/409 |

FOREIGN PATENT DOCUMENTS

| | | | |
|---|---|---|---|
| 705536 | 3/1954 | United Kingdom | 260/409 |
| 245021 | 10/1969 | U.S.S.R. | 260/409 |

OTHER PUBLICATIONS

Chemical Abstracts, vol. 91, 89814t (1979).
Chemical Abstracts, vol. 98, 108434g (1983).
Chemical Abstracts, vol. 83 26496e (1975).
F. Nozaki and R. Adachi, *J. Catalysis*, 40, 166 (1975).

*Primary Examiner*—Helen M. S. Sneed
*Attorney, Agent, or Firm*—Thomas K. McBride; William H. Page, II; Eugene I. Snyder

[57] ABSTRACT

A supported, phosphorus-modified zerovalent nickel catalyst shows improved selectivity in the hydrogenation of fatty materials. The increased selectivity of this catalyst permits continuous reduction of fatty materials with a selectivity comparable to that observed in batch reduction using a more conventional nickel catalyst.

8 Claims, No Drawings

SELECTIVE REDUCTION OF EDIBLE FATS AND OILS USING PHOSPHORUS-MODIFIED NICKEL CATALYSTS

BACKGROUND OF THE INVENTION

Although some edible oils are used per se, by far the largest portion are hydrogenated, or hardened, prior to their end use. The reason for such hydrogenation is to increase the stability of the final product. For example, processed soybean oil is susceptible to oxidation resulting in deterioration of its organoleptic properties upon storage even at ambient temperature. Where the oil is to be used at higher temperatures, for example, as a frying oil, the adverse organoleptic consequences of oxidation become even more pronounced.

The commonly accepted origin of oxidative deterioration is the presence of highly unsaturated components, such as the triene moiety, linolenate, in soybean oil. Partial hydrogenation to remove most of this component leads to a marked increase in the oxidative stability of the resulting product, thereby facilitating storage and permitting unobjectionable use at higher temperatures. Ideally, one desires this hydrogenation to be highly specific, reducing only triene to the diene, linoleate, without reducing diene or monoene and without effecting cis to trans isomerization. In practice, this goal is unachievable.

The edible fats and oils which are the subject of this invention are triglycerides of fatty acids, some of which are saturated and some of which are unsaturated. In vegetable oils, the major saturated fatty acids are lauric (12:0), myristic (14:0), palmitic (16:0), stearic (18:0), arachidic (20:0), and behenic (22:0) acids. The notation, "18:0," for example, means an unbranched fatty acid containing 18 carbon atoms and 0 double bonds. The major unsaturated fatty acids of vegetable oils may be classified as monounsaturated, chief of which are oleic (18:1) and erucic (22:1) acids, and polyunsaturated, chief of which are the diene linoleic acid (18:2), and the triene linolenic acid (18:3). Unhardened vegetable fats and oils contain virtually exclusively cis unsaturated acids.

In the context of partial, light hydrogenation, the ultimate goal is the reduction of triene to diene without attendant trans acid formation or saturate formation. In practice, it is observed that partial reduction results in lowering both triene and diene and increasing the monoene, saturate, and trans levels. Because it is desired that the product of partial hydrogenation itself be a liquid oil relatively free of sediment or even cloudiness upon storage at, for example, 10° C., the formation of saturated and trans acids in such hydrogenation is a vexing problem. Removal of these solids, whose relative amount is measured by the Solid Fat Index (SFI), is a relatively costly and inefficient process attended by large losses associated with the separation of gelatinous solids from a viscous liquid. It is known in the art that such solids are composed largely of triglycerides containing at least one saturated fatty acid moiety and/or trans monounsaturated fatty acid moiety with the predominant culprits having at least 18 carbon atoms. It is further known in the art that fatty acid analysis alone is an insensitive analytical tool, that is to say, two products of hydrogenation of, for example, soybean oil may be vastly different in their SFI while having virtually identical fatty acid analysis. This arises because the distribution of the saturated moieties in the triglyceride is important. The solubility in the soybean oil of disaturated triglycerides is much less than twice that of monosaturated triglycerides, and the solubility of monosaturated triglycerides may depend upon whether the other fatty acid moieties of the triglyceride are monounsaturated, diunsaturated, etc., and may also depend upon whether the saturated portion is at the one or two position of the triglyceride.

In the context of more extensive but still partial hydrogenation selectivity remains a goal. What is particularly desired is to reduce triene and diene levels without an accompanying substantial increase in saturates, i.e., conversion of triene and diene to monoene as exclusively as possible. Another frequent goal in partial hydrogenation also associated with selectivity is formation of a product with a steep SFI slope. By this is meant a product with a high SFI in the interval from 10° C. to about 27° C. decreasing rapidly in the interval from about 27° C. to about 40° C., with little or no solids at about 40° C.

From the foregoing it should be clear that hydrogenation of edible fats and oils is largely an empirical process, whose analytical tools include SFI supported by fatty acid analysis. The difficulty of achieving desirable results, in the context of selectivity in Solid Fat Index, has largely limited such hydrogenation to a batch type process. Although the transition from a batch to a continuous process, especially of the fixed bed type, is conceptually facile, it will be recognized by the skilled worker that impediments have been substantial.

I have discovered that phosphorus-modified nickel catalysts display virtually unchanged activity but substantially increased selectivity relative to the unmodified nickel in the hydrogenation of fatty materials. Such catalysts appear to consist, at least in part, of nickel phosphide or related species. The latter has been shown to reduce 1,3-butadiene, a conjugated diene, (F. Nozaki and R. Adachi, *J. Catalysis*, 40, 166 (1975)) by exclusively 1,4-addition. Since the double bonds in the fatty materials of this invention are isolated double bonds, i.e., non-conjugated double bonds, it is surprising to find the nickel phosphide specie(s) of this invention participating in 1,2-reduction, a conclusion which follows from the unaltered, or sometimes increased, catalytic activity. It is also totally unexpected that the catalysts of this invention are so selective in reducing the isolated double bonds of triene and diene relative to monoene. As a consequence of my discovery I have developed a method of selectively hydrogenating fatty materials, which is my invention. An important advantage of my invention is that it provides a method of continuous hydrogenation of fatty materials with good selectivity, a goal long pursued but commercially unrealized.

SUMMARY OF THE INVENTION

The object of this invention is to provide a method of selectively hydrogenating fatty materials. An embodiment comprises contacting the fatty materials with a supported, phosphorus-modified nickel catalyst under hydrogenation conditions. In a specific embodiment the nickel is supported on a non-porous alumina and is modified by hypophosphorous acid. In another embodiment the catalyst is prepared by reduction of nickel phosphate. In yet another embodiment the hydrogenation is conducted in a continuous manner by contacting a flowing mass of fatty material with a fixed mass of the aforementioned catalyst under hydrogenation conditions. Other embodiments and objects will appear from the description within.

DESCRIPTION OF THE INVENTION

Selective hydrogenation of fatty materials, especially in a continuous mode, has been an elusive goal often pursued but seldom achieved. Zerovalent nickel, usually supported on an inert carrier, has become the standard catalyst in the industry, representing the best compromise of economy, selectivity, ease of handling, and relative freedom from detrimental effects. However, processes using zerovalent nickel as the catalyst are almost invariably batch reductions since the selectivity of the catalyst is insufficient to permit a continuous selective hydrogenation. The invention herein is a method of selectively hydrogenating fatty materials comprising contacting a fatty material with a supported, phosphorus-modified nickel catalyst under hydrogenation conditions in the presence of hydrogen, and recovering the resulting product. The invention is made possible by our discovery that the supported, phosphorus-modified zerovalent nickel catalysts of this invention afford sufficient selectivity to meet or exceed the commercial standards in a continuous process for hydrogenation of fatty materials.

One index of selectivity used herein is the Solid Fat Index, as described above. Another index of selectivity relied upon here and commonly used elsewhere can be better understood from the following partial reaction sequence, where k is the rate constant for the indicated hydrogenation step.

$$18{:}3 \xrightarrow{k_3} 18{:}2$$

$$18{:}2 \xrightarrow{k_2} 18{:}1$$

$$18{:}1 \xrightarrow{k_1} 18{:}0$$

$$S_{LN} = k_3/k_2$$
$$S_{LO} = k_2/k_1$$

$^S$LN is termed the linolenate selectivity; a high value is characterized by relatively high yields of dienoic acid in the reduction of an unsaturated triglyceride containing trienoic acids. $^S$LO is the linoleate selectivity; a high value is characterized by relatively high yields of monoenoic acid in a reduction of an unsaturated triglyceride containing dienoic acids. An oil such as soybean oil contains both trienoic and dienoic acids, thus $^S$LN and $^S$LO may be measured simultaneously.

The catalyst used in the process of this invention affords hydrogenated products with substantially improved SFI profiles and shows substantially increased values of $^S$LN and $^S$LO relative to the nickel catalysts of the prior art. Such increased selectivity permits continuous hydrogenation of fatty materials, a long-sought goal in the industry.

The method described herein is generally applicable to edible oils and fats of vegetable and animal origin, collectively referred to herein as fatty materials. It is equally applicable to partial hydrogenation of liquid oils to afford hardened, but still liquid, oils, and to more extensive, but still partial, hydrogenation to afford product which is either largely solid or which contains large amounts of solids. Examples of fatty materials which may be used as feedstock include soybean oil, cottonseed oil, sunflower oil, corn oil, safflower oil, rapeseed oil, and palm oil. The application of this method to soybean oil is especially important. Because partially hydrogenated oils often are used as a feedstock for the preparation of more extensively hydrogenated material, such partially hydrogenated oils, however prepared, also are intended to be subsumed under the phrase "fatty materials" in the practice of this invention. In particular, it is to be explicitly understood that suitable feedstock includes partially hydrogenated soybean oil, cottonseed oil, sunflower oil, corn oil, safflower oil, rapeseed oil, palm oil, and blends thereof.

The catalysts used in the practice of this invention are supported, phosphorus-modified zerovalent nickel. Because the effect of phosphorus on the selectivity appears to be dependent on a close association of phosphorus and nickel, there is a requirement that the nickel be not too highly dispersed on the carrier, which requires that the carrier not have too high a surface area. This is equivalent to the requirement that the support be relatively non-porous, especially in the micropore region. For the purpose of this application a micropore is one under about 117 Å in size. For the purpose of this disclosure a non-porous support is one with a micropore volume less than about 0.3 ml per g. Examples of carriers suitable for use in this invention include alumina, silica, titania, thoria, magnesia, zirconia, kaolin, bentonite, kieselguhr, and combinations thereof. Alumina is an especially desirable carrier, and most alpha aluminas and theta-aluminas are particularly suitable in the practice of this invention.

An exception to the requirement of a non-porous carrier occurs if the nickel is largely distributed on the surface of a carrier. That is to say, if the zerovalent nickel is selectively dispersed at or near the surface of the carrier functioning as a support, then the porosity of the carrier is not material to the success of this invention and carriers with high surface area and high micropore volume may be employed.

The catalyst used herein is zerovalent nickel modified by phosphorus. Among the methods leading to phosphorus-modified nickel catalysts are reduction of nickel phosphate, or some combination of nickel phosphate with another nickel salt or zerovalent nickel, treatment of supported zerovalent nickel with such phosphorous sources as hypophosphorous acid, phosphoric acid, and aryl and alkyl phosphines and phosphine oxides, followed by reduction in hydrogen, or treatment of a supported nickel oxide with phosphorous sources such as those illustrated above followed by reduction. Among the listed phosphorous sources hypophosphorous acid is a preferred material. For example, a suitable support may be impregnated with a solution of nickel phosphate to give material containing from about 1 to about 10% nickel. The impregnated support is reduced in hydrogen at a temperature from about 400° to about 800° C., with a temperature range from about 500° to about 700° C. being preferred.

As another example, a supported, zerovalent nickel may be impregnated with hypophosphorous acid. The resulting material may be reduced with hydrogen at a temperature between about 400° and about 800° C., with a range from about 500° to about 700° C. being preferred. As still another example, a suitable carrier impregnated with nickel oxide may be subsequently impregnated with hypophosphorous acid. The resulting material then may be reduced as described above to give a catalyst of this invention.

The phosphorus-modified zerovalent nickel catalyst contains from about 0.4% to about 15% by weight of phosphorus relative to nickel. At higher phosphorous levels the activity of the catalyst drops significantly, although the selectivity is increased, and at phosphorous levels greater than about 15% by weight relative to nickel the activity is reduced to a commercially unacceptable level. Within the aforementioned range a phosphorous content from about 2 to about 10% by weight relative to nickel is preferred. For example, if a catalyst contains 5% nickel, then it may contain from about 0.02 to about 0.75% phosphorus, with a content from about 0.1 to about 0.5% being preferred.

The level of nickel often is dictated by the requirement of a non-porous support. Thus, a nickel content from about 1 to about 10% by weight is generally used, with a catalyst containing from about 1 to about 5% nickel being even more frequently employed.

The fatty material and the supported phosphorus-modified nickel catalysts are contacted with hydrogen under hydrogenation conditions. Such conditions include a temperature from about 125° to about 275° C., with a range from about 150° to about 255° C. being particularly desirable. Hydrogen may be present at a pressure up to about 150 psi, although lower pressure hydrogenation seems to be the industry norm, with a pressure from about 5 to about 50 psi being preferred.

Examination of the catalysts of this invention by electron spectroscopy for chemical analysis (ESCA) is particularly informative. This analytical technique probes the surface and to a depth only within about 30 to 40 Å of the surface, identifying the elements present and their oxidation state. Such investigation generally shows two regions of absorption associated with phosphorous specie. The major absorption occurs in a region associated with phosphate. Another region of absorption is associated with a phosphide species, although the nature of the phosphide species cannot be determined. From comparison of various catalysts it can be determined that the increased selectivity of the catalysts of this invention is associated with the aforementioned phosphide species.

The process of this invention may be used in a batch manner. For example, into a stirred autoclave may be placed suitable fatty material and the supported phosphorus-modified zerovalent nickel catalyst of this invention. Hydrogen may be admitted at a pressure up to about 150 psi, and the mass may be stirred at a temperature from about 125° to about 275° C. for a time sufficient to achieve the desired level of hydrogenation. At that time the reaction mixture may be cooled, hydrogen removed, and the resulting product recovered simply by moving the catalyst, as by filtration.

My invention may be practiced even more advantageously by conducting the hydrogenation in a continuous mode. For example, a flowing mass, preferably upwardly flowing, of a fatty material may be contacted with a fixed mass of a supported, phosphorus-modified zerovalent nickel catalyst of this invention. Said catalyst may contain zerovalent nickel at a level from about 1 to about 10% supported on, for example, alpha-alumina or theta-alumina and may contain from about 0.4 to about 15% by weight of phosphorus relative to nickel (or 0.02 to 0.75% phosphorus relative to the carrier). Contacting may be performed at a hydrogen pressure up to about 150 psi and at a temperature from about 125° to about 275° C., with the resulting product recovered as the effluent.

The following examples are merely illustrative of this invention, which is not intended to be limited thereto.

In the following examples macropore volume refers to pores greater than about 117 Å in size.

EXAMPLE 1

Phosphorus-free catalysts were prepared by mixing the alumina base with an aqueous solution of $Ni(NO_3)_2.6H_2O$ sufficient to afford the desired amount of nickel and steam evaporating the water. The impregnated alumina was then calcined in air at 450° C. for 7 hours and reduced in flowing hydrogen at 440° C. for 4 hours.

Phosphorus-modified catalysts were prepared by one of the following methods.

Method A. Alumina was impregnated with nickel by steam evaporation of a $Ni(NO_3)_2.6H_2O$ solution, followed by calcination in air at 450° C. for 7 hours followed by reduction in hydrogen at 440° C. for 4 hours. The resulting material was then impregnated with an aqueous solution of hypophosphorous acid by steam impregnation followed by reduction in hydrogen at 500° C. for 1.5 hours.

Method B. Alumina was impregnated with nickel and calcined in air as in method A. The resulting material was impregnated with aqueous hypophosphorous acid by steam evaporation followed by reduction in hydrogen at 600° C. for 4 hours.

Method C. Alumina was impregnated with an aqueous solution of $Ni_3(PO_4)_2.7H_2O$ containing about 9 weight percent phosphoric acid by steam evaporation. The impregnate was reduced in hydrogen at 500° C. for 2 hours.

Method D. Alumina was mixed for 1 hour with a sufficient solution of $Ni(NO_3)_2.6H_2O$ to afford 2.4% nickel by weight relative to alumina. After liquid was decanted the alumina was mixed on a rotary mixer with a solution of 0.1N NaOH for 1 hour, after which liquid was decanted. The material was washed with deionized water and steam evaporated for 2 hours. The solid was calcined with flowing air at 500° C. for 2 hours and then reduced with flowing $H_2$ at 500° C. for 2 hours. The alumina supported Ni was impregnated with aqueous hypophosphorous acid by steam evaporation, and the resulting material was reduced in hydrogen at 500° C. for 2 hours.

The various catalysts prepared, both unmodified (to serve as controls) and phosphorus modified, are summarized below.

TABLE 1

| | Catalyst Description | | |
|---|---|---|---|
| Sample | Composition | Base Properties | Preparative Method |
| 1 | 5% Ni/α-alumina | 0.20 ml/g macropore vol.<br>0.03 ml/g micropore vol. | — |
| 2 | 0.1% P-5% Ni/α-alumina | 0.20 ml/g macropore vol.<br>0.03 ml/g micropore vol. | A |
| 3 | 0.5% P-5% Ni/α-alumina | 0.20 ml/g macropore vol. | B |

TABLE 1-continued

| Sample | Composition | Base Properties | Preparative Method |
|---|---|---|---|
| | | Catalyst Description | |
| 4 | 5% Ni/α-alumina | 0.03 ml/g micropore vol.<br>0.49 ml/g macropore vol.<br>0.14 ml/g micropore vol. | |
| 5 | 0.1% P-5% Ni/α-alumina | 0.49 ml/g macropore vol.<br>0.14 ml/g micropore vol. | A |
| 6 | 1.0% P-5% Ni/α-alumina | 0.49 ml/g macropore vol.<br>0.14 ml/g micropore vol. | A |
| 7 | 0.5% P-5% Ni/θ-alumina | 2.04 ml/gm macropore vol.<br>.01 ml/gm micropore vol. | B |
| 8 | 12% P-5% Ni/θ-alumina | 2.04 ml/gm macropore vol.<br>.01 ml/gm micropore vol. | C |
| 9 | 0.75% P-5% Ni/γ- alumina | 0.3 ml/gm macropore vol.<br>0.5 ml/gm micropore vol. | A |
| 10 | 0.5% P-2.4% Ni/γ-alumina | 0.3 ml/gm macropore vol.<br>0.5 ml/gm micropore vol. | D |

EXAMPLE 2

Catalyst samples 2 and 5 were examined by ESCA. Both catalysts had the same nickel and phosphorous content and were prepared by the same method, but differed in that catalyst 5 was substantially more porous. Spectra of the P (2p) region show phosphate present in both samples, but only catalyst 2 shows an appreciable amount of phosphide. Examination of the Ni (2p) spectrum of the latter sample indicated the presence of $Ni_2P$, which was absent in the other sample.

A summary of ESCA results for other catalysts is presented in Table 2.

TABLE 2

| Sample | Catalyst Characterization by ESCA<br>Surface Composition<br>Atom % Ni | Atom % P | Phosphate | Phosphide |
|---|---|---|---|---|
| 2 | 10.28 | 2.17 | yes | yes |
| 3 | 22.01 | 7.69 | yes | yes |
| 5 | 9.45 | 1.75 | yes | no |
| 6 | 8.23 | 8.60 | yes | yes |
| 7 | 1.87 | 1.14 | yes | no |
| 8 | 1.03 | 15.26 | yes | yes |
| 9 | 1.81 | 1.07 | yes | no |
| 10 | 1.37 | 1.77 | yes | yes |

EXAMPLE 3

The performance of several of the catalysts was scanned in the fixed bed hydrogenation of soybean oil. In all cases hydrogenation was done at 50 psig hydrogen at a LHSV of 3.0 hr.$^{-1}$ and a mole ratio of hydrogen to feed of 3.2. For sample 6 the hydrogenation was 150° C.; for the other entries the temperature was 195° C. The iodine value (IV) of the effluent (product) was calculated from the fatty acid composition as determined from gas-liquid partition chromatography.

TABLE 3

| Sample | Catalyst Performance in Hydrogenation of Soybean Oil<br>IV (product) | $S_{LN}$ | $S_{LO}$ |
|---|---|---|---|
| 1 | 100.9 | 1.9 | 8.5 |
| 2 | 93.5 | 2.8 | 15.3 |
| 4 | 83.9 | 2.2 | 8.8 |
| 5 | 84.7 | 2.2 | 8.6 |
| 6 | 129.8 | 3.3 | 27.7 |

Comparison of samples 1 and 2 shows the phosphorus-modified catalyst is not only more selective, but also more active (lower IV of product) than the unmodified catalyst. Comparison of samples 4 and 5 show that in the absence of phosphide a nickel catalyst containing phosphorus performs the same as a catalyst without phosphorus. Comparison of sample 6 with 4 and/or 5 shows that when phosphide is present selectivity increases. However, the high IV of the product from sample 6 demonstrates the unacceptably low activity for a catalyst with relatively high phosphorous content.

EXAMPLE 4

In this example the performance of sample 3 in the continuous hydrogenation of soybean oil is presented in greater detail. A fixed bed hydrogenation was conducted at a constant LHSV of 0.6 hr.$^{-1}$ and $H_2$/feed mole ratio of 3.2 while varying the temperature and, to a lesser degree, the pressure to maintain an effluent of IV about 75. Results are summarized in Table 4.

TABLE 4

| | | | | | | |
|---|---|---|---|---|---|---|
| IV (calc/refractive index) | 74.6 (72.4) | 72.8 (71.6) | 70.6 (69.7) | 76.7 (73.2) | 77.0 (74.8) | 74.3 |
| ΔIV | 63.3 | 65.1 | 67.3 | 61.4 | 61.1 | 63.8 |
| $S_{LO}$ | 13.5 | 12.4 | 10.5 | 13.7 | 14.0 | 12.1 |
| $S_{LN}$ | 2.2 | 1.8 | 1.7 | 1.8 | 2.0 | 1.9 |
| MDP °C. | 41.7 | 43.4 | 45.0 | 42.1 | 41.6 | — |
| % TRANS | 49.3 | — | 46.6 | — | 49.1 | 46.0 |
| SFI | | | | | | |
| 50° | 62.3 | 64.4 | 65.9 | 61.2 | 60.1 | |
| 70° | 49.8 | 53.3 | 56.0 | 50.6 | 48.0 | |
| 80° | 43.3 | 47.6 | 51.5 | 43.7 | 41.5 | |
| 92° | 23.4 | 28.5 | 33.5 | 24.7 | 22.5 | |
| 104° | 4.7 | 8.7 | 11.8 | 5.3 | 4.2 | |
| 18-0 | 11.9 | 13.2 | 15.2 | 11.3 | 10.9 | 12.6 |
| 18-1 | 67.4 | 66.8 | 65.4 | 66.9 | 66.6 | 66.0 |
| 18-2 | 9.2 | 8.2 | 7.6 | 10.2 | 10.6 | 9.4 |
| 18-3 | 0.1 | 0.2 | 0.2 | 0.2 | 0.2 | 0.2 |

What is claimed is:

1. A method of selective hydrogenation of fatty materials comprising contacting a fatty material with a supported, phosphide-containing zerovalent nickel catalyst having from about 0.4 to about 15 wt. % phosphorus relative to nickel at a temperature from about 125° to about 275° C. in the presence of hydrogen at a pressure up to about 150 psi, and recovering the resulting product.

2. The method of claim 1 where the fatty material is selected from the group consisting of soybean oil, cottonseed oil, sunflower oil, corn oil, safflower oil, rapeseed oil, palm oil, and blends thereof.

3. The method of claim 1 where the fatty material is selected from the group consisting of partially hydrogenated soybean oil, cottonseed oil, sunflower oil, corn oil, safflower oil, rapeseed oil, palm oil, and blends thereof.

4. The method of claim 1 where the catalyst is supported on a carrier selected from the group consisting of alumina, silica, titania, thoria, magnesia, zirconia, kaolin, bentonite, kieselguhr, and combinations thereof, with a micropore volume less than about 0.3 ml per gram.

5. The method of claim 4 where the carrier is alumina.

6. The method of claim 1 where the catalyst contains from about 2 to about 10% by weight phosphorus relative to nickel.

7. The method of claim 1 where the temperature is from about 150° to about 255° C.

8. The method of claim 1 where the pressure is from about 5 to about 50 psi.

* * * * *